US006657420B1

(12) United States Patent
Shacter

(10) Patent No.: US 6,657,420 B1
(45) Date of Patent: Dec. 2, 2003

(54) ACCURATE ULTRA-LOW CURRENT GENERATOR

(75) Inventor: Stuart B. Shacter, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 199 days.

(21) Appl. No.: 09/999,119

(22) Filed: Oct. 19, 2001

(51) Int. Cl.[7] ..... G05F 1/40
(52) U.S. Cl. ..... 323/288; 323/313; 363/73
(58) Field of Search ..... 323/282, 283, 323/284, 288, 312, 313, 314; 363/73

(56) References Cited

U.S. PATENT DOCUMENTS 5,949,666 A * 9/1999 Daniele et al. ..... 323/288 X
6,177,787 B1 * 1/2001 Hobrecht ..... 323/288 X
6,329,803 B1 * 12/2001 Hitchcock ..... 323/288

* cited by examiner

*Primary Examiner*—Jessica Han
(74) *Attorney, Agent, or Firm*—Brett A. Hertzberg; Merchant & Gould P.C.

(57) ABSTRACT

A method and apparatus provide for accurate low current generation using switched capacitor techniques. The current generator includes a reference voltage generator that provides a reference signal to a switched capacitor integrator. In one example, the reference circuit includes a switched capacitor divider. The switched capacitor integrator circuit produces a voltage ramp in response to the reference signal and other timing signals. The rate of the voltage ramp is proportional to the ratio of capacitors in the switched capacitor integrator and a clock frequency that is associated with the timing signals. A feedback circuit impresses the voltage ramp across an output capacitor circuit that has a very low capacitance value. The capacitor is arranged to differentiate the voltage ramp to produce an accurate low current. The switched capacitor design is suitable for integration in a monolithic integrated circuit. The integrator and the feedback stage are periodically reset.

20 Claims, 4 Drawing Sheets

ACCURATE ULTRA-LOW CURRENT GENERATOR

FIELD OF THE INVENTION

The present invention is related to and apparatus and method for generating low currents. More particularly, the present invention is related to current generators that accurately generate low currents using switched capacitor techniques.

BACKGROUND OF THE INVENTION

An accurate current can be generated with an operational amplifier that is arranged in a feedback loop. The operational amplifier (op-amp) is arranged to force a known reference voltage across a known resistor value. The resistor and op-amp are arranged to convert the reference voltage to current. An example current generator circuit (400) that uses an operational amplifier is illustrated in FIG. 4.

As shown in FIG. 4, current generator circuit (400) includes an N-type field effect transistor (FET MSF), three resistors (R41–R43), and an operational amplifier (AMP40). FET MSF includes a gate that is connected to a control node, a drain that is connected to an output node (OUT), and a source that is connected to a feedback node. Resistor R41 is connected between the feedback node and ground. Resistors R42 and R43 are series connected between a voltage reference terminal (VREF) and ground. Amplifier AMP40 includes a non-inverting input that is connected to a common node between resistors R42 and R43, an inverting input that is connected to the feedback node, and an output that is coupled to the control node.

In operation, a reference voltage (VREF) is applied to the current generator circuit (400). Resistors R42 and R43 operate as a resistor divider that provides a second reference voltage (VR2) in response to the reference voltage (VREF). FET MSF receives a control voltage (VCTL) from the output of amplifier AMP40 and produces an output current (IOUT). The output current (IOUT) flows through resistor R41, which produces a feedback voltage (VFB). Amplifier AMP40 provides the control voltage (VCTL) in response to a comparison between the second reference voltage (VR2) and the feedback voltage (VFB). Amplifier AMP40 provides control of FET MSF such that output current IOUT is determined by the second reference voltage (VR2) divided by the resistance of R41.

SUMMARY OF THE INVENTION

The present invention is directed to a method and apparatus for accurately generating low currents using switched capacitor techniques. The current generator includes a reference voltage generator that provides a reference signal to a switched capacitor integrator. In one example, the reference circuit includes a switched capacitor divider. The switched capacitor integrator circuit produces a voltage ramp in response to the reference signal and other timing signals. The rate of the voltage ramp is proportional to the ratio of capacitors in the switched capacitor integrator and a clock frequency that is associated with the timing signals. A feedback circuit impresses the voltage ramp across an output capacitor circuit that has a very low capacitance value. The capacitor is arranged to differentiate the voltage ramp to produce an accurate low current. The switched capacitor design is suitable for integration in a monolithic integrated circuit. The integrator and the feedback stage are periodically reset.

A more complete appreciation of the present invention and its improvements can be obtained by reference to the accompanying drawings, which are briefly summarized below, to the following detailed description of illustrative embodiments of the invention, and to the appended claims.

DETAILED DESCRIPTION OF THE PREFERRED EMBODIMENT

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal.

The present invention is directed at accurately producing a very low current using switched capacitor techniques. A voltage ramp signal is produced in response to a reference signal using a switched capacitor integrator. A voltage-to-current converter circuit receives the voltage ramp signal. An output capacitor in the voltage-to-current converter is arranged to produce a controlled current in response to the voltage ramp signal. The value of the output capacitor and the rate of the voltage ramp signal are chosen such that a very small capacitor may be utilized with a relatively slow voltage ramp. In one example, the capacitor and voltage ramp are arranged to provide an accurate output current on the order of 10 pA. The small capacitors and switched capacitor design are suitable for use in an integrated circuit.

Figure 1:
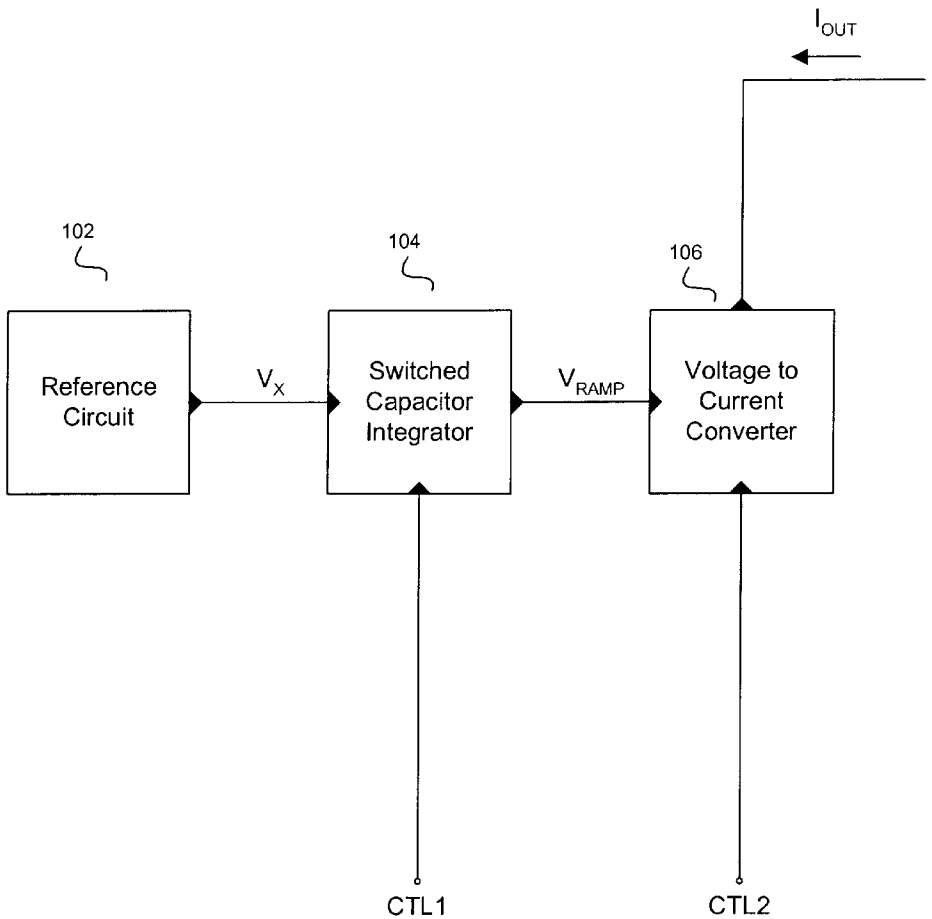
FIG. 1 is a schematic block diagram of an exemplary current generator.

FIG. 1 is a schematic block diagram of an exemplary current generator (100). Current generator 100 includes a reference circuit (102), a switched capacitor integrator circuit (104), and a voltage-to-current converter circuit (106). Reference circuit 102 has an output that is coupled to an input of switched capacitor integrator circuit 104. Switched capacitor integrator circuit 104 has another input that is arranged to receive a first control signal (CTL1), and an output that is coupled to an input of voltage-to-current converter circuit 106. Voltage-to-current converter circuit 106 has another input that is arranged to receive a second control signal (CTL2), and an output that is arranged to provide an output signal (IOUT).

In operation, reference circuit 102 produces a reference signal (VX). Switched capacitor integrator circuit 104 produces a ramp signal (VRAMP) in response to the reference signal (VX) and the first control signal (CTL1). Voltage-to-current converter 106 produces the output signal (IOUT) in response to the ramp signal (VRAMP) and the second control signal (CTL1). The output current signal (IOUT) is related to the rate of the ramp signal (VRAMP).

Reference circuit 102 may be any voltage reference that is suitable for switched capacitor integrator circuit 104. In one example, reference circuit 102 includes a band-gap type of reference circuit that provides a voltage on the order of 1.25V. In another example, the reference circuit 102 includes a switched capacitor circuit that operates as a voltage-divider. In still another example, the reference circuit includes a buffer that is arranged to isolate reference circuit 102 from the switched capacitor integrator circuit 104.

The first and second control signals (CTL1, CTL2) correspond to one or more control signals that are necessary to control switch timing of switched capacitor integrator 104 and voltage-to-current converter 106. In one example, the first control signal includes a reset control line, and at least two clock signals. The reset control line may be utilized to reset the integrator, while the clock signals may be used to control the switch timing in the integrator. The clock signals may be related to one another such as inverses of one another. The clock signals may also be non-overlapping clock signals. The clock signals may correspond to different phases that are derived from a single clock signal. Second control signal CTL2 may similarly include clock signals and reset control for voltage-to-current converter 106.

Ramp signal VRAMP corresponds to a voltage signal that increases gradually over time. In one example, the voltage of VRAMP increases at a rate of 1 volt per second (a slow ramp).

Voltage-to-current converter circuit 106 produces output signal IOUT in response to ramp signal VRAMP and second control signal CTL2. Signal IOUT has a current that is proportional to the rate at which the voltage of VRAMP increases over time as will be discussed in further detail with reference to FIG. 2.

Figure 2:
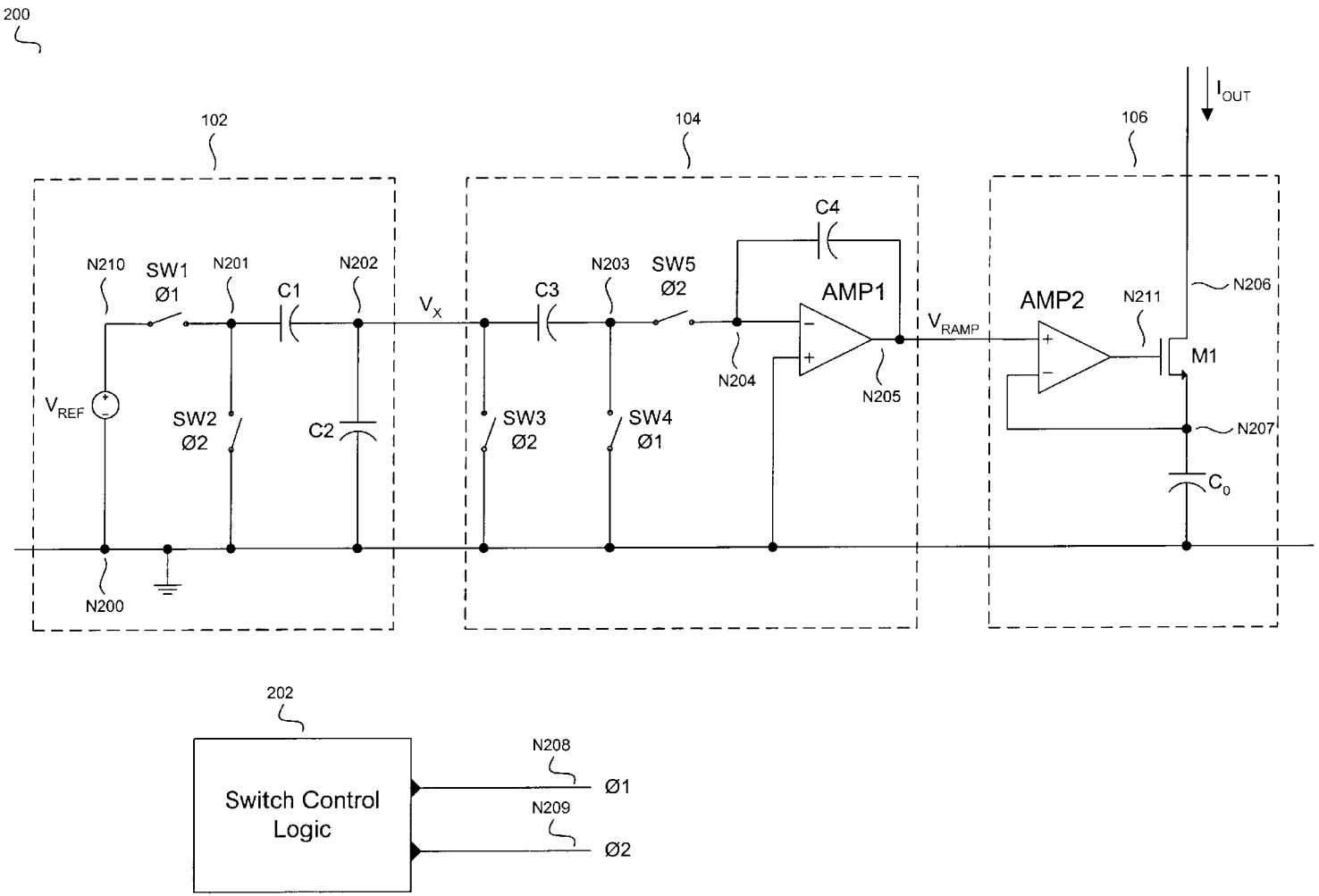
FIG. 2 is a detailed schematic diagram of an exemplary current generator.

FIG. 2 is a schematic diagram of an exemplary current generator circuit (200) that is in accordance with the present invention. Similar to current generator circuit 100 shown in FIG. 1, current generator circuit 200 includes a reference circuit (102), a switched capacitor integrator circuit (104), and a voltage-to-current converter circuit (106). Current generator circuit 200 also includes a switch control logic circuit (202).

Switch control logic circuit 202 has an output that is coupled to node N208 and another output coupled to node N209. The output at node N208 corresponds to a first clock signal (Ø1), while the output at node N209 corresponds to a second clock signal (Ø2).

Reference circuit 102 includes a voltage source (VREF), two switches (SW1–SW2), and two capacitors (C1, C2). Voltage source VREF is coupled to node N210. Capacitor C1 is coupled between node N201 and node N202. Capacitor C2 is coupled between node N200 and node N202. Node N200 is connected to ground. Switch SW1 is coupled between node N210 and N201. Switch SW2 is coupled between node N201 and N200. Switch SW1 is arranged to selectively couple node N210 to node N201 in response to the first clock signal (Ø1). Switch SW2 is arranged to selectively couple node N201 to node N200 in response to the second clock signal (Ø2).

Switched capacitor integrator circuit 104 includes three switches (SW3–SW5), two capacitors (C3–C4), and an amplifier circuit (AMP1). Switch SW3 is coupled between node N202 and node N200. Switch SW4 is coupled between node N203 and node N200. Switch SW5 is coupled between node N203 and node N204. Capacitor C3 is coupled between node N202 and node N203. Capacitor C4 is coupled between node N204 and node N205. Amplifier AMP1 has an inverting input that is coupled to node N204, a non-inverting input that is coupled to node N200, and an output that is coupled to node N205. Switch SW3 is arranged to selectively couple node N202 to node N200 in response to the second clock signal (Ø2). Switch SW4 is arranged to selectively couple node N203 to node N200 in response to the first clock signal (Ø1). Switch SW5 is arranged to selectively couple node N203 to node N204 in response to the second clock signal (Ø2).

Voltage-to-current converter circuit 106 includes a transistor (M1), an amplifier circuit (AMP2), and a capacitor (C0). Amplifier AMP2 has a non-inverting input that is coupled to node N205, an inverting input that is coupled to node N207, and an output that is coupled to node N211. Transistor M1 has a gate that is coupled to node N211, a source that is coupled to node N207, and a drain that is coupled to node N206. Capacitor C0 is coupled between node N207 and node N200.

During operation, switch control logic 202 produces clock signals Ø1 and Ø02. In one example, the first clock signal (Ø1) corresponds to an inverse of the second clock signal (Ø2). In another example, the first clock signal (Ø1) and the second clock signal (Ø2) correspond to a set of non-overlapping clock signals. For proper operation of the switched capacitor circuit employed in current generator circuit 200, switch SW1 and SW4 cannot be active at the same time that switches SW2, SW3 and SW5 are active, and vice-versa.

The operation of current generator circuit 200 has two phases of operation corresponding to the clock signals. During phase Ø2, switches SW2, SW3, and SW5 are closed and the remaining switches are open. The operating phases for current generator circuit 200 are discussed as follows below.

Phase Ø1 Operation

During phase Ø1, switches SW1 and SW4 are closed, and switches SW2, SW3, and SW5 are open.

The voltage source (VREF) is coupled to capacitor C1. Capacitors C1, C2 and C3 are arranged as a capacitive voltage divider such that a voltage (VX) is produced at node N202 in response to the voltage source (VREF). The reference voltage (VX) is determined by the voltage source and the capacitor values such that:

$$VX = VREF \cdot \left[\frac{C1}{(C1 + C2 + C3)}\right] \quad \text{(I)}$$

At the end of phase Ø1, capacitor C3 is fully charged to VX. Thus, capacitor C3 stores a charge (Q3) corresponding to:

$$Q3 = VX \cdot C3 \quad \text{(II)}$$

Substituting equation (I) into equation (II) yields:

$$Q3 = VREF \cdot \left[\frac{C1 \cdot C3}{(C1 + C2 + C3)}\right] \quad \text{(III)}$$

Since switch SW5 is open, amplifier AMP1 and capacitor C4 maintain a relatively constant output voltage (VRAMP) at node N205 during phase Ø1.

Phase Ø2 Operation

During phase Ø2, switches SW1 and SW4 are open, and switches SW2, SW3, and SW5 are closed.

The voltage source (VREF) is decoupled from capacitor C1, and capacitors C1 and C2 are fully discharged to ground through switches SW2 and SW3. The charge that was previously stored on capacitor C3 (i.e., C3·VX) is transferred to capacitor C4 such that AMP1, and capacitors C3 and C4 operate as an integrator. A current flows through capacitor C3 when the capacitor is coupled to ground through switch SW3. The current flow (I) through C3 is determined by the change in charge in capacitor C3:

$$I = \frac{\Delta Q3}{\Delta t} \tag{IV}$$

Substituting equation (II) into equation (IV) yields:

$$I = \left(\frac{VX}{\Delta t}\right) \cdot C3 \tag{V}$$

All of the current (I) that is flowing through capacitor C3 must also flow through capacitor C4. The current in capacitor C4 is determined by the change in the voltage (VC4) on capacitor C4 as:

$$I = C4 \cdot \left(\frac{\Delta VC4}{\Delta t}\right) \tag{VI}$$

Solving for the change in voltage on capacitor C4 yields:

$$\Delta VC4 = \left(\frac{1}{C4}\right) \cdot \Delta t \tag{VII}$$

Substituting equation (V) into equation (VII) yields:

$$\Delta VC4 = VX \cdot \left(\frac{C3}{C4}\right) \tag{VIII}$$

The output voltage (VRAMP) from amplifier AMP1 will correspond to an initial ramp voltage ($VRAMP_i$) at the end of each phase Ø1 clock cycle. During the phase Ø2 clock cycle, the ramp voltage will increase by an amount corresponding to equation (VIII). The ramp signal (VRAMP) may thus be determined by the following equation:

$$VRAMP = VRAMP_i + \Delta VC4 \tag{IX}$$

Combining equation (IX) and (VIII) yields:

$$VRAMP = VRAMP_i + VX \cdot \left(\frac{C3}{C4}\right) \tag{X}$$

Finally, combining equation (X) and (I) yields:

$$VRAMP = VRAMP_i + VREF \cdot \left(\frac{C3}{C4}\right) \cdot \left[\frac{C1}{(C1 + C2 + C3)}\right] \tag{XI}$$

Amplifier circuit AMP2 receives the ramp signal (VRAMP) from node N205 and provides a control signal to node N211. Transistor M1 is configured as a follower circuit such that the voltage at node N207 will follow the ramp signal (VRAMP). Capacitor C0 will conduct a current (IOUT) as the ramp signal increases such that:

$$IOUT = CO \cdot \left(\frac{\Delta VRAMP}{\Delta t}\right) \tag{XII}$$

The time period associated with the voltage ramp is determined by the frequency (f) of switching in the switched capacitor circuits. Since f=1/Δt, the output current is determined as:

$$IOUT = CO \cdot \left(\frac{C3}{C4}\right) \cdot \left[\frac{C1}{(C1 + C2 + C3)}\right] \cdot f \cdot VREF \tag{XIII}$$

A variety of control parameters may be adjusted to change the output current. First, the ratio of C1 and (C1+C2+C3) may be adjusted to scale the source voltage (VREF) and produce an appropriate reference voltage (VX) for integration. Second, the reference voltage (VX) is scaled by the ratio of capacitors C3 and C4 to adjust the step size of the ramp signal (VRAMP). Thus, the rate of the ramp signal can be changed by either the frequency (f) or the ratio C3/C4. Lastly, the overall output current is scaled by the value of capacitor C0.

In one example, $C1=C3$, $C2=10 \cdot C1$, $C4=100 \cdot C1$, and $VRAMP=VREF \cdot f/1200$ In this example, VRAMP increases by VREF/1200 in each clock cycle.

In another example, $VREF=1.2V$, $f=100$ KHz, $C0=200$ fF, $C1=C3$, $C2=10 \cdot C1$, $C4=100 \cdot C3$, and $IOUT=10$ pA.

As illustrated in the above discussion and examples, very small accurate currents can be achieved with the present invention. The capacitors in current generator 200 are related to one another as ratios. By arranging the ratios carefully, the output current (IOUT) is controlled. A variety of trimming techniques may be employed to change the designated output current as may be desired. The capacitor ratios may be dynamically selectable. For example, the ratio of C3 and C4 may be used to control the step size of the ramp, which in turn will control the output current to increase. A set of switches may be arranged to select one or more capacitors in parallel and/or series combination as capacitor C3 and/or C4. Thus, any desired ratio for C3/C4 may be achieved by activating the appropriate switches. The selection may be designated by a memory such as a register. Other capacitors may also be dynamically selected to adjust the overall output current. Alternatively, the clock frequency can be changed to control the ramp signal.

Figure 3:
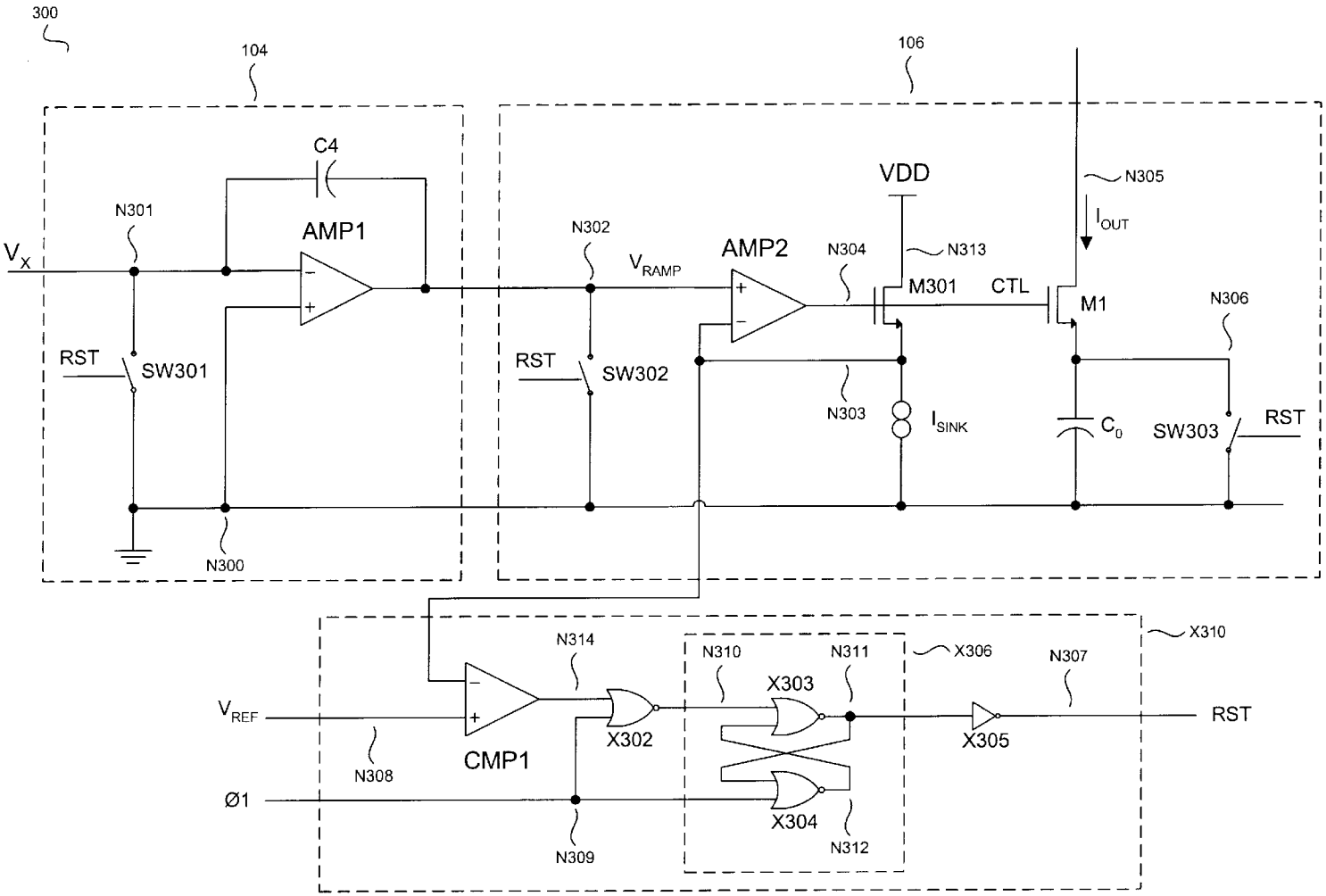
FIG. 3 is a partial schematic diagram of an exemplary current generator, which is in accordance with the invention.
Figure 4:
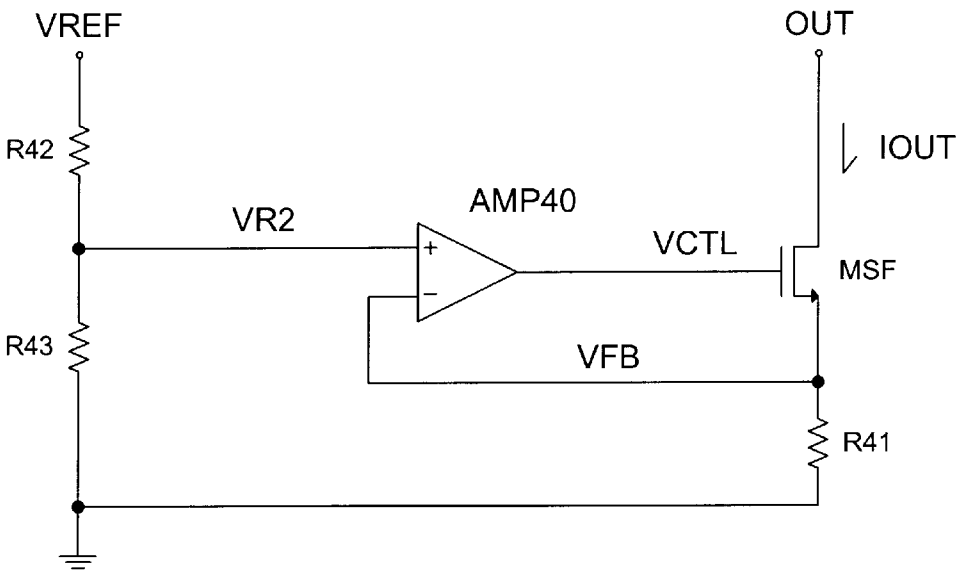
(PRIOR ART) FIGURE 4
FIG. 4 is a schematic diagram of a conventional current generator.

FIG. 3 is a schematic diagram illustrating a partial view of a current generator circuit (300) that is accordance with the present invention. The partial view shown in FIG. 3 operates substantially similar to that illustrated in FIG. 2. Current generator 300 includes switched capacitor integrator circuit 104, voltage-to-current converter circuit 106, and reset logic circuit X310. Switched capacitor integrator circuit 104 includes switch SW301, capacitor C4, and amplifier AMP1. Voltage-to-current generator circuit 106 includes amplifier AMP2, transistors M1 and M301, a current source (Isink), switches SW302–SW303, and capacitor C0.

Switch SW301 is coupled between node N300 and node N301, and has a control termninal that is coupled to node N307. Node N300 is connected to ground. Capacitor C4 is coupled between node N301 and node N302. Amplifier AMP1 has a non-inverting input that is coupled to node N300, an inverting input that is coupled to node N301, and an output that is coupled to node N302. Switch SW302 is coupled between nodes N300 and N302, and has a control terminal that is coupled to node N307. Amplifier AMP2 has an inverting input that is coupled to node N303, a non-inverting input that is coupled to node N302, and an output that is coupled to node N304. Transistor M301 has a gate that is coupled to node N304, a source that is coupled to node N303, and a drain that is coupled to node N313. Current source Isink is coupled between nodes N300 and N303. Transistor M1 has a gate that is coupled to node N304, a source that is coupled to node N303, and a drain that is coupled to node N313. Capacitor C0 is coupled between nodes N300 and N306. Switch SW303 is coupled between node N300 and node N306, and has a control terminal that is coupled to node N307.

Reset logic circuit X310 includes comparator CMP1, NOR gate X302, latch X306, and inverter X305. Latch X306 includes NOR gates X303 and X304. Comparator CMP1 has an inverting input that is coupled to node N303, a non-inverting input that is coupled to node N308, and an output that is coupled to node N314. NOR gate X302 has an input that is coupled to node N314, another input that is coupled to node N309, and an output that is coupled to node N310. NOR gate X303 has an input that is coupled to node N310, another input that is coupled to node N312, and an output that is coupled to node N311. NOR gate X304 has an input that is coupled to node N309, another input that is coupled to node N311, and an output that is coupled to node N312. Inverter X305 is coupled between nodes N311 and N307.

In operation, switched capacitor integrator circuit 104 and voltage-to-current circuit 106 each function substantially the same as in current generator 200, with the addition of switches SW301, SW302, and SW303. Switch SW301, switch SW302, and switch SW303 are arranged to operate as reset switches. Switches SW301–SW303 are closed when a reset signal (RST) is active. The logical level of signal RST is determined by reset logic circuit X310. Switches SW301–SW303 are reset periodically in response to signal RST such that the integration capacitor (C4) and the output capacitor are completely discharged to ground.

Amplifier AMP2 is arranged to simultaneously drive transistors M301 and M1. Transistor M1 is a source follower that is used in conjunction with amplifier AMP2 to impress ramp signal VRAMP on capacitor C0. Transistor M301 and current source Isink are arranged to provide negative feedback to amplifier AMP2. Transistor M301 also allows amplifier AMP2 to have improved stability since the feedback voltage at node N303 is not affected by transient events in capacitor C0.

Reset logic circuit X310 determines when ramp signal VRAMP should be reset. Comparator X301 compares source voltage VREF to the voltage at node N303. The voltage at node N303 follows ramp voltage VRAMP. The reset signal (RST) is forced to be a low logic signal when the ramp signal (VRAMP) is below VREF. Comparator CMP1 provides a low logic signal to NOR gate X302 when the ramp voltage exceeds VREF (or alternatively another predetermined level), enabling the latch. Signal Ø1 is also coupled to NOR gate X302. NOR gate X302 will only produce an output with a high logical level when the phase Ø1 is not active and the voltage at node N303 exceeds VREF. The output of NOR gate X302 acts as a set signal for the latch (X306), while signal Ø1 acts as an enable signal. When the output of NOR gate X302 is a high logic level, the logical level of RST will be high until the next rising edge of signal Ø1 (i.e., a reset logic pulse).

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus for generating an output current comprising:

a switched capacitor integrator circuit that is configured to produce a ramp voltage in response to a reference signal and timing signals, wherein the timing signals are associated with a clock cycle, and the ramp voltage changes by a predetermined voltage at each subsequent clock cycle; and a voltage-to-current converter circuit that is configured to produce the output current in response to the ramp voltage.

2. The apparatus as in claim 1, further comprising a voltage reference circuit that is arranged to provide the reference signal.

3. The apparatus as in claim 2, wherein the voltage reference circuit includes a band-gap reference circuit.

4. The apparatus as in claim 2, wherein the voltage reference circuit includes a buffer that is arranged to isolate the switched capacitor integrator circuit from the voltage reference circuit.

5. The apparatus as in claim 2, the voltage reference circuit further comprising an input voltage, and a switched capacitor divider circuit that is arranged to provide the reference signal in response to the timing signals and the input voltage.

6. The apparatus as in claim 1, further comprising:

a first capacitor circuit that is selectively coupled to an input voltage in response to a first one of the timing signals;

a second capacitor circuit that is coupled to the first capacitor circuit; and a third capacitor circuit that is coupled to the first and second capacitor circuits, wherein the first, second and third capacitor circuits are arranged to provide the reference signal in response to the input voltage and the first one of the timing signals such that reference signal is stored in the third capacitor circuit.

7. The apparatus as in claim 6, wherein the reference signal is determined by:

$$VREF \cdot \left[\frac{C1}{(C1 + C2 + C3)}\right],$$

wherein C1 is an effective capacitance of the first capacitance circuit, C2 is an effective capacitance of the second capacitance circuit, C3 is an effective capacitance of the third capacitance circuit, and VREF corresponds to the input voltage.

8. The apparatus as in claim 1, the switched capacitor integrator circuit further comprising:

a first capacitor circuit that is selectively coupled to the reference signal in response to a first one of the timing signals, such that the first capacitor circuit stores a charge that is related to the reference signal; and a second capacitor circuit that is selectively coupled to the first capacitor circuit in response to a second one of the timing signals, such that the charge stored on the first capacitor is transferred to the second capacitor.

9. The apparatus as in claim 8, the switched capacitor integrator circuit further comprising an amplifier circuit, wherein the second capacitor circuit is coupled between the an input and an output of the amplifier circuit such that the second capacitor integrates and provides the ramp voltage.

10. The apparatus as in claim 8, wherein the predetermined voltage changes by an amount corresponding to:

$$VX \cdot \left(\frac{C1}{C2}\right),$$

wherein C1 is an effective capacitance of the first capacitance circuit, C2 is an effective capacitance of the second capacitance circuit, and VX corresponds to the voltage of the reference signal.

11. The apparatus as in claim 10, wherein a rate associated with the ramp signal is adjusted by changing at least one of the effective capacitance of the first capacitance circuit, the effective capacitance of the second capacitance circuit, and the clock cycle.

12. The apparatus as in claim 8, wherein the predetermined voltage is adjusted by changing the effective capacitance of at least one of the first and second capacitance circuits.

13. The apparatus as in claim 1, the voltage-to-current converter circuit further comprising an output capacitor circuit that is arranged to differentiate an output voltage to produce the output current, wherein the output voltage is related to the ramp voltage.

14. The apparatus as in claim 13, the voltage-to-current converter circuit further comprising a feedback circuit that is arranged to impress the output ramp voltage across the output capacitor circuit.

15. The apparatus as in claim 13, the voltage-to-current converter circuit further comprising:

an amplifier circuit that is arranged to provide a control signal in response to the output voltage and the ramp voltage; and a transistor that is arranged to couple the output voltage to the output capacitor in response to the control signal such that the output voltage substantially the same as the ramp voltage.

16. The apparatus as in claim 13, the voltage-to-current converter circuit further comprising:

an amplifier circuit that is arranged to provide a control signal in response to a feedback voltage and the ramp voltage;

a first transistor that is arranged to couple the output voltage to the output capacitor in response to the control signal such that the output voltage is substantially the same as the ramp voltage; and a second transistor that is arranged to provide the feedback voltage in response to the control signal such that the feedback voltage is substantially the same as the ramp voltage.

17. The apparatus as in claim 1, further comprising:

a comparator circuit that is arranged to produce a logic signal when the ramp voltage reaches a predetermined maximum level;

a logic circuit that is arranged to provide a reset pulse in response to the logic signal and at least one of the timing signals;

a first reset circuit that is arranged to reset the switched capacitor integrator circuit in response to the reset pulse; and a second reset circuit that is arranged to reset the voltage-to-current converter circuit in response to the reset pulse.

18. A method for generating an output current comprising:

storing a charge in a first capacitive circuit during a first clock phase, wherein the charge is determined by a reference voltage;

transferring the charge from the first capacitive circuit to a second capacitive circuit during a second clock phase;

producing a ramp voltage in response to the charge transfer from the first capacitive circuit to the second capacitive circuit; and differentiating the ramp voltage with a third capacitive circuit to produce an output current, wherein the output current is determined by an effective capacitance of the third capacitive circuit and a rate associated with the ramp voltage.

19. The method as in claim 18 further comprising:

resetting the ramp voltage when the ramp voltage reaches a predetermined level; and resetting an output voltage that is associated with the third capacitive circuit when the ramp voltage reaches a predetermined level.

20. An apparatus for generating an output current comprising:

a means for storing a charge in a first capacitive circuit during a first clock phase, wherein a reference voltage determines the charge;

a means for transferring the charge from the first capacitive circuit to a second capacitive circuit during a second clock phase;

a means for producing a ramp voltage in response to the charge transfer from the first capacitive circuit to the second capacitive circuit; and a means for differentiating the ramp voltage with a third capacitive circuit to produce an output current, wherein the output current is determined by an effective capacitance of the third capacitive circuit and a rate associated with the ramp voltage.

* * * * *

UNITED STATES PATENT AND TRADEMARK OFFICE

CERTIFICATE OF CORRECTION

PATENT NO. : 6,657,420 B1
DATED : December 2, 2003
INVENTOR(S) : Shacter

It is certified that error appears in the above-identified patent and that said Letters Patent is hereby corrected as shown below:

Column 7,
Line 2, "has a control termninal" should read -- has a control terminal --

Signed and Sealed this

Twenty-fourth Day of February, 2004

JON W. DUDAS
*Acting Director of the United States Patent and Trademark Office*